United States Patent [19]

Yamada

[11] Patent Number: 4,720,111

[45] Date of Patent: Jan. 19, 1988

[54] GOLF BALL

[75] Inventor: Kaname Yamada, Kakogawa, Japan

[73] Assignee: Sumitomo Rubber Industries Ltd., Hyogo, Japan

[21] Appl. No.: 629,386

[22] Filed: Jul. 10, 1984

[30] Foreign Application Priority Data

Nov. 21, 1983 [JP] Japan ..... 58-220277

[51] Int. Cl.[4] ..... A63B 37/14

[52] U.S. Cl. ..... 273/232; 40/327

[58] Field of Search ..... 273/232, 233, 234, 235 R, 273/235 A, 235 B; 40/327

[56] References Cited

U.S. PATENT DOCUMENTS

| | | | |
|---|---|---|---|
| 878,254 | 2/1908 | Taylor | 273/232 |
| 4,090,716 | 5/1978 | Martin et al. | 273/232 |
| 4,141,559 | 2/1979 | Melvin et al. | 273/220 |

FOREIGN PATENT DOCUMENTS

| | | | |
|---|---|---|---|
| 967188 | 5/1975 | Canada | 273/232 |
| 377354 | 7/1932 | United Kingdom | 273/232 |
| 2103939A | 3/1983 | United Kingdom | 273/232 |

OTHER PUBLICATIONS

"The Curious History of the Golf Ball" by John Stuart Martin, Horizon Press, New York—1968—pp. 126–131.

*Primary Examiner*—George J. Marlo
*Attorney, Agent, or Firm*—Armstrong, Nikaido, Marmelstein & Kubovcik

[57] ABSTRACT

A golf ball which can achieve an extra distance at the low-speed range of its trajectory from the peak point to the ground to give an increased overall flight distance, said golf ball having a plurality of dimples formed in an exactly or substantially identical arrangement pattern in each of eight equal portions of a spherical surface divided by phantom lines, said arrangement pattern being provided on the spherical surface of the golf ball for forming 416 or 504 dimples without adjacent dimples overlapping each other, said golf ball being in the range of 500 to 1000 in a value defined by the equal $$\alpha = \left( \sum_{k=1}^{n-1} (Ek - 1 \times Ek) + 2 \times \sum_{k=1}^{n-1} Ek^2 \right) \times N/r^2$$

wherein

D: the diameter (mm) of dimples,

N: the total number of dimples,

R: the diameter (mm) of golf ball,

Ek: The diameter (mm) of dimple at a a point k microns away from the dimple edge downward, i.e. in the direction of depth of dimple (apparent diameter of dimple when the dimpled land portion is cut in parallel with the plane containing the dimple edge at its opening), and n: the depth of dimple (in microns)

For a ball having 416 dimples, the preferred dimple diameter is 3.2–3.6 mm and a depth of dimple such that the total dimple volume is 222–476 mm$^3$.

3 Claims, 6 Drawing Figures

GOLF BALL

TECHNICAL FIELD

The present invention relates to golf balls, and more particularly to a golf ball which is optimized in the shape, number and arrangement of dimples and which is thereby adapted to give an increased distance in the low-speed region of its trajectory, i.e. the descending portion thereof from the peak point to the ground.

BACKGROUND OF THE INVENTION

Golf balls having varying numbers of dimples in different arrangements are known. With many of golf balls, the arrangement dimples is determined in the following manner. On a spherical surface externally in contact with a reqular polyhedron, the ridge lines of the polyhedron are projected to obtain lines of projection as phantom lines 2 dividing the spherical surface as seen in FIG. 3. Dimples 1 are formed in an identical arrangement in each of the portions 3 of the spherical surface divided by the phantom dividing lines 2. The regular polyhedron may be a regular octahedron, regular dodecahedron or regular icosahedron, and the corresponding dimple arrangement will hereinafter be referred to as a "regular octahedral arrangement," "regular dodecahedral arrangement" or "regular icosahedral arrangement."

Golf balls heretofore proposed are divided generally into the following five types according to the arrangement pattern and total number of dimples.

A: Golf balls having about 336 dimples 1 in a regular octahedral arrangement as seen in FIG. 3 (showing only the dimples in substantially $\frac{1}{8}$ part of the whole area of the spherical surface).

B: Those having about 332 dimples or about 392 dimples generally in an icosahedral arrangement symmetric with respect to the parting line.

C: Those having about 330 to 344 dimples as arranged on concentric circles or in a similar arrangement.

D: Those having 360 dimples in a regular dodecahedral arrangement.

E: Those having 252 dimples in a regular icosahedral arrangement.

Of these, the balls B and C are poor in symmetrical pattern of dimple arrangements because the plane of symmetry containing the center of the ball is limited only to the parting line and thus have some directionality.

The balls A, D and E, each having a regular polyhedral dimple arrangement, are symmetric with respect to planes containing the center of the sphere and the phantom dividing lines 2 and are therefore high in equivalency and superior to the balls B and C.

However, the balls D and E in which the planes of symmetry containing the center of the ball do not intersect one another at right angles are difficult to address, to tee up for making tee shots and to putt along the desired line and accordingly have not been widely accepted.

The ball A having a regular octahedral dimple arrangement is symmetric with respect to planes intersecting one another, is free of the above drawbacks, has been traditionally used and is primarily used at present.

Almost all the balls having this dimple arrangement are provided with 336 dimples although the number of dimples somewhat differs, for example, because the space for the print of brand name has varying sizes.

On the other hand, the golf ball flies at a high speed of 40 to 80 m/sec while rotating also at a high speed of 2000 to 10,000 r.p.m. For the golf ball to achieve an added distance during flying in a low-speed region of its trajectory, i.e. the descending portion thereof from the peak point to the ground, it is required that the change from turbulent air flow separation to laminar air flow separation should take place in a region of the lowest possible speed. The dimples formed in the surface of the ball must fulfill this requirement among other physical functions. In order to maintain the condition of such turbulent air separation as long as possible, it is proposed to lengthen the dimple edge to the greatest possible extent. This can be obtained by giving a larger diameter to the dimples and/or forming an increased number of dimples.

With the ball A having 336 dimples, the above effect can be achieved by increasing the diameter of the dimples. In the case of the dimple arrangement of this ball, the pitch of dimples differs from location to location and is only 3.9 mm when small. Accordingly with small-sized balls having a diameter of 41.15 mm, it is impossible to form too large dimples in view of the number of dimples.

SUMMARY OF THE INVENTION

An object of the present invention is to provide a golf ball which is balanced in respect of the shape, total number and arrangement of dimples and which is thereby adapted to achieve an added distance while flying at a low speed from the highest point to the ground to give an increased flight distance.

Another object of the invention is to provide a golf ball having 400 to 550 dimples in a regular octahedral arrangement.

Another object of the invention is to provide the following experimental equation representing the relationship between the dimples and the increase of flight distance in the low-speed region.

$$\alpha = \left( \sum_{k=1}^{n-1} (Ek - 1 \times Ek) + 2 \times \sum_{k=1}^{n-1} Ek^2 \right) \times N/R^2$$

wherein

D: the diameter(mm) of dimples,

N: the total number of dimples,

R: the diameter(mm) of golf ball,

Ek: the diameter(mm) of dimple at a point k microns away from the dimple edge downward, i.e. in the direction of depth of dimple (apparent diameter of dimple when the dimpled land portion is cut in parallel with the plane containing the dimple edge at its opening), and n: the depth of dimple (in microns).

Still another object of the present invention is to provide a golf ball ranging from 500 to 1000 in the above mentioned $\alpha$ value.

DETAILED DESCRIPTION OF THE INVENTION

Figure 1:
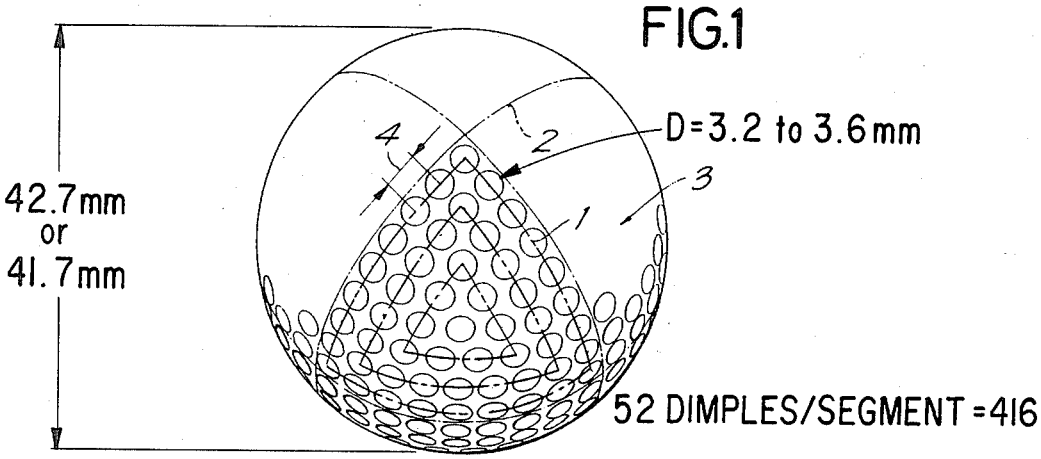
FIG. 1 is a view showing a golf ball embodying the invention showing an arrangement pattern having 416 dimples in a regular octahedral arrangement, the dimples only in substantially $\frac{1}{8}$ part of the whole surface area of the ball being shown.

The increase of distance in a low-speed region of the trajectory of the golf ball, i.e. the descending portion thereof from the peak point to the ground is dependent largely on the size of the ball and the diameter and number of dimples. The present inventor has repeatedly conducted various experiments on the relationship between these factors and found that the greater the K value of the following experimental equation, i.e. the larger the length of the dimple edge per unit surface area of the golf ball, the greater is the increase of distance in the low-speed region to give a larger total flight distance.

$$K = D \times N / R^2 \qquad \text{(i)}$$

wherein

D: the diameter(mm) of dimples,

N: the total number of dimples, and

R: the diameter(mm) of golf ball.

The present inventor has further found that the $\alpha$ value of the following experimental equation is preferably in the range of 500 to 1000.

$$\alpha = \left( \sum_{k=1}^{n-1} (Ek - 1 \times Ek) + 2 \times \sum_{k=1}^{n-1} Ek^2 \right) \times N/R^2 \qquad \text{(ii)}$$

wherein

Ek: the diameter(mm) of dimple at a point k microns away from the dimple edge downward, i.e. in the direction of depth of dimple (apparent diameter of dimple when the dimpled land portion is cut in parallel with the plane containing the dimple edge at its opening), and n: the depth of dimple (in microns).

As used herein the term "the diameter of dimple", in the case of a circular shaped dimple, refers to a diameter of the circle provided on a phantom plane which comes into contact with the dimple, or to a diameter between both contact points passing both dimple edges when the dimple is cut in a plane including the center points of the dimple and the ball. In the case of a non-circular shaped dimple, "the diameter of dimple" refers to a diameter as the circular shaped dimple having a circumferential dimension equal to total length of the dimple edge sides.

As used herein the term "the depth of dimple" refers to a depth at the deepest point away from the horizontal plane including the dimple edge.

As used herein the term "the pitch of dimple" indicates the distance calculated in the following manner. On the spherical surface of the ball, the center-to-center distances between a specified dimple and other dimples adjacent to the specified dimple were measured to obtain only 4 values taken out in order of the shortest distance therebetween. The dimple pitch is defined by the average obtained by these 4 values. Hereupon, the center-to-center distance indicates the length of the larger circular arc connected with two points where each center point of the two dimples is projected on the spherical surface of the ball.

The $\alpha$ value serves as an index of the dimple size.

The volume of a dimple having the depth of n micron is approximately determined by the following formula:

$$\frac{0.001}{12} \pi \sum_{k=1}^{M-1} (Ek - 1 \times 2Ek^2) \qquad \text{(iii)}$$

With respect to the equation (ii) mentioned in the foregoing, the expression in the bracket is obtained by deleting a constant part of $0.001/12\pi$ and indicates the relative volume per one dimple. A way to obtain the formula (iii) will be described below.

Figure 4:
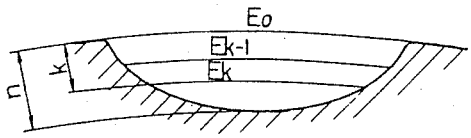
FIG. 4 is an enlarged view in section showing a dimple.

With reference to FIG. 4, a frustoconical portion with two surfaces having diameters of Ek-1 and Ek and parallel to the plane of the dimple opening has a volume $\Delta V$ ($mm^3$) which is represented by $$\Delta V = 0.001/12\pi(Ek-1^2 + Ek-1 \cdot Ek + Ek^2)$$

The effective volume $$\sum_{k=1}^{n-1} \Delta V$$

with respect to a dimple having a depth of n microns is expressed as follows, when $Eo^2$ is omitted and $En-1^2$ is made approximate to $En^2$ through calculating thereof:

$$\sum_{k=1}^{n-1} \Delta V = \frac{0.001}{12} \pi \sum_{k=1}^{n-1} (Ek - 1 \cdot Ek + 2Ek^2)$$

When the constant portion ($0.001/12\pi$) is omitted, the foregoing calculation equation is obtained.

So far as the circular shaped dimple is concerned, the $\alpha$ value provides following considerations;

If the diameter and depth of dimples are definite, the $\alpha$ value increases with an increase in the number of dimples and decreases with a decrease in the dimple number. When the diameter and number of dimples are definite, the $\alpha$ value increases with an increase in the depth of dimples and decreases with a decrease in the dimple depth. Further when depth and number of dimples are definite, the $\alpha$ value increases with an increase in the diameter of dimples and decreases with a decrease in the dimple diameter.

Figure 3:
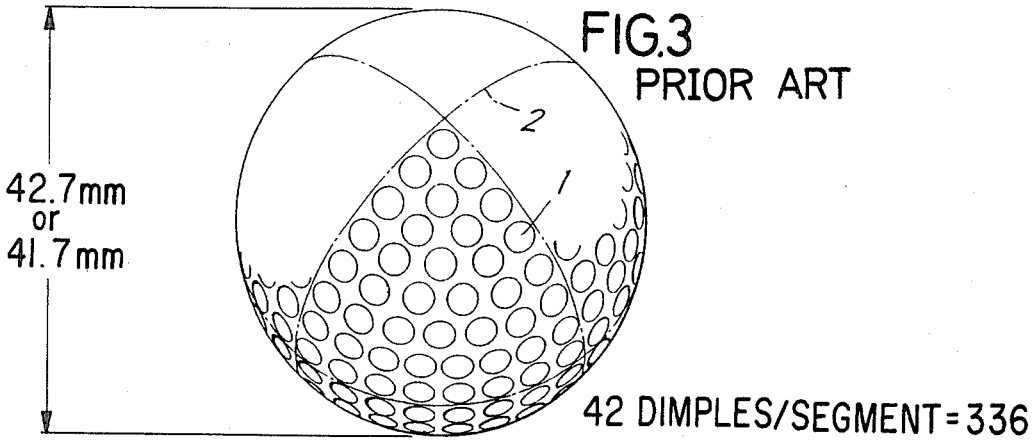
FIG.3 PRIOR ART
FIG. 3 is a view showing a conventional golf ball having 336 dimples in a regular octahedral arrangement, the view showing the dimples only in substantial ⅛ part of the whole surface area of the ball.

FIG. 3 shows a small-sized conventional ball having a diameter of 41.15 mm and 336 dimples in a regular octahedral arrangement. With this ball, the center-to-center distance 4 between adjacent dimples which are closest to each other is about 3.9 mm. When D, the diameter of the dimples is 3.9, the K value is 0.774.

When the dimple diameter is larger than 3.9, adjacent dimples will overlap. Thus, the K value may be as great as 0.774.

When the number of dimples is increased to 416 according to a regular octahedral arrangement pattern as shown in FIG. 1, D can be 3.5. In this case, the K value is 0.860 which is 11% higher than the corresponding value of the 336-dimple arrangement.

The K value increases with a further increase in the number of dimples in the octahedral arrangement pattern, giving a further increased distance in the descending portion of the trajectory of the ball. However, if the number of dimples is more than 550, the pitch of dimples becomes smaller than 2.87 mm, with the result that the dimples that can be arranged are as small as less than 2.8 mm in diameter.

Further to achieve the $\alpha$ value defined by the equation (ii), the depth of dimples must be as small as less than 0.15 mm in the above case, that is, as described in the immediately preceding sentence. This is not desirable since when the ball is repeatedly shot, the dimples will deform greatly to produce a difference between the initial performance thereof and the performance after repeated use. Optimally, the number of dimples is about 400 to about 550.

Figure 2:
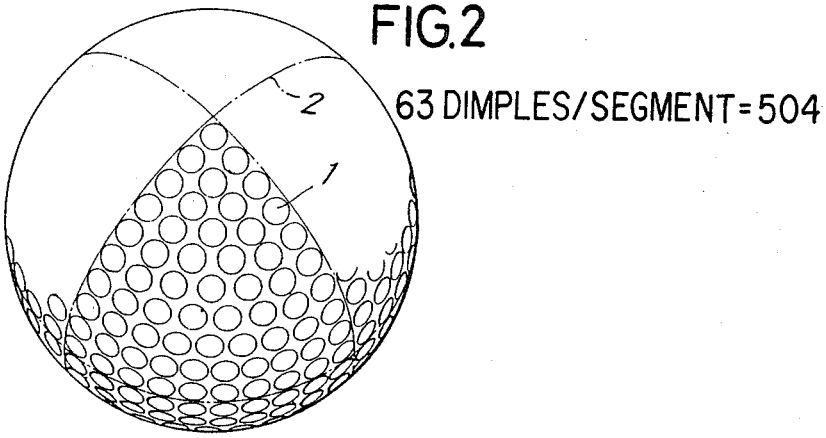
FIG. 2 is a view showing a golf ball embodying the invention showing an arrangement pattern having 504 dimples in a regular octahedral arrangement, the view showing the dimples only in substantially ⅛ part of the whole surface area of the ball.

The number of dimples to be in the octahedral arrangement can be various multiples of 8. However, to obtain dimple pitches within the smallest range of variations, it is desirable that the total number of dimples be 416 or 504 as shown in FIG. 1 or 2.

A golf ball having 416 dimples with a diameter of 42.67 mm is also in the range of 3.7 to 4.2 mm in respect of the pitch of dimples.

A golf ball having 504 dimples with a diameter of 42.67 mm ranges from 3.3 to 3.7 mm in the dimple pitch.

Examples are given below to show that the golf balls of the invention achieve increased distances.

The golf ball was tested for distance by hitting the ball at a speed of 45 m/sec with a No. 1 wood club set on a hitting test machine. The results are given in Tables 1 to 3, in which each test value is the average obtained by shooting 8 samples twice.

The terms in Tables 1 to 3 mean the following.

Carrying distance: The distance of flight of the ball from the hitting point to the point where the ball hit the ground.

Rolling distance: The distance the ball ran from the landing point to the point where the ball came to rest.

Total distance: The carrying distance plus the rolling distance.

Shape of trajectory: "Good" means that the ball hit achieve an appreciable extra distance. "Hop" means that the ball hopped at peak point of the trajectory. "Weak ball" means that the ball hit failed to achieve any noticeable extra distance, describing a markedly descending trajectory.

EXAMPLE 1

Thread-wound balata-covered balls, 41.2 mm in diameter, were tested for distance. Table 1 shows the results. Sample Nos. 1 to 10 are golf balls according to the invention, while sample Nos. 101 to 114 are those prepared for comparison.

Figure 5:
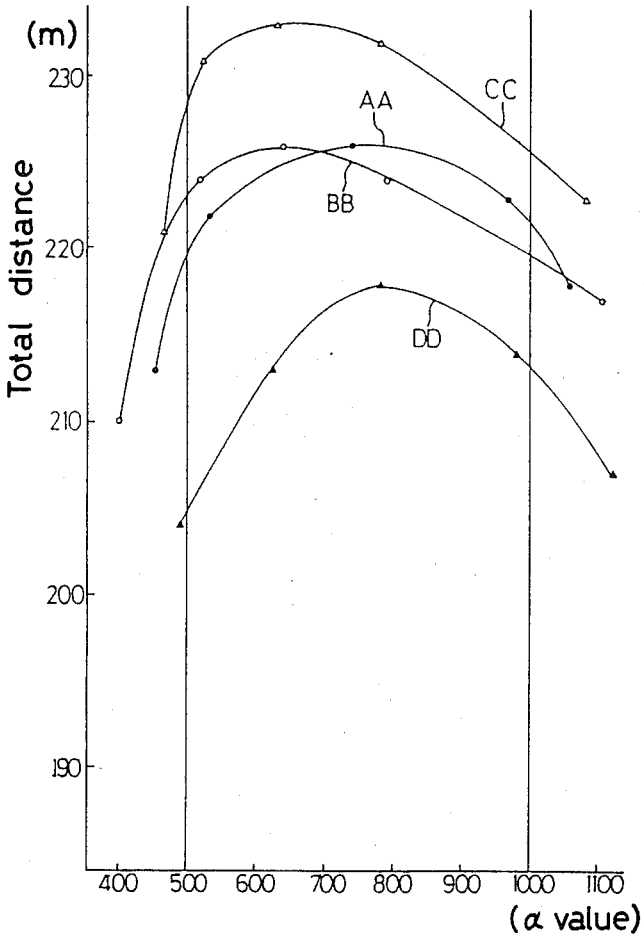
FIG. 5 is a graph showing the relationship between the $\alpha$ value and the total distance of flight.

Sample Nos. 1 to 5, 111 and 112 are golf balls having 416 dimples. FIG. 5, curve AA shows the relationship between the total distance and the $\alpha$ value as determined with sample Nos. 1 to 5, 111 and 112. Sample Nos. 6 to 10, 113 and 114 are golf balls having 504 dimples. FIG. 5, curve BB shows the relationship between the total distance and the $\alpha$ value as achieved by sample Nos. 6 to 8, 113 and 114.

Table 1 reveals the following. Sample Nos. 1 to 4 (having 416 dimples with a diameter of about 3.45 mm) are at least 5 m longer in total distance than sample Nos. 101 to 110 having 336 dimples. The former balls exhibit a satisfactory trajectory with an extra distance without hopping in the vicinity of the peak point or without a rapid descent with reduced power.

Sample No. 5, which has a small K value, is slightly inferior to sample Nos. 1 to 4 but superior to sample Nos. 101 to 110 in total distance.

Sample Nos. 6 to 10 (having 504 dimples with a diameter of about 3.05 mm) are at least 7 m longer than sample Nos. 101 to 110 having 336 dimples in total distance and are superior thereto also in the form of trajectory.

Sample Nos. 111 to 114, although similar to sample Nos. 1 to 4 and 6 to 10 in K value, are outside the range of 500 to 1000 in $\alpha$ value and are inferior to the golf balls of the invention in total distance.

TABLE 1

| | Dimples | | | | Carrying | Rolling | Total | | Flight | |
|---|---|---|---|---|---|---|---|---|---|---|
| No. | Number | Diameter (mm) | K value | $\alpha$ value | Distance (m) | Distance (m) | Distance (m) | Height of Trajectory | Time (sec) | Shape of Trajectory |
| 1 | 416 | 3.45 | 0.846 | 530 | 208 | 14 | 222 | Slightly high | 5.99 | Good |
| 2 | 416 | 3.44 | 0.843 | 965 | 199 | 24 | 223 | Slightly low | 5.16 | Good |
| 3 | 416 | 3.49 | 0.855 | 690 | 207 | 19 | 226 | Usual | — | Good |
| 4 | 416 | 3.41 | 0.836 | 740 | 204 | 21 | 225 | Usual | 5.51 | Good |
| 5 | 416 | 3.22 | 0.789 | 697 | 204 | 16 | 220 | Usual | — | Good |
| 6 | 504 | 3.06 | 0.909 | 515 | 208 | 16 | 224 | Slightly high | 5.89 | Good |
| 7 | 504 | 3.03 | 0.900 | 635 | 206 | 20 | 226 | Usual | 5.68 | Good |
| 8 | 504 | 3.05 | 0.906 | 790 | 201 | 23 | 224 | Usual | 5.36 | Good |
| 9 | 504 | 3.03 | 0.900 | 635 | 207 | 21 | 228 | Usual | — | Good |
| 10 | 504 | 2.91 | 0.864 | 630 | 206 | 18 | 224 | Usual | — | Good |
| 101 | 336 | 3.55 | 0.703 | 400 | 181 | 14 | 195 | Varying | 6.15 | Unstable |
| 102 | 336 | 3.45 | 0.683 | 534 | 197 | 8 | 205 | High | 6.35 | Marked hop |
| 103 | 336 | 3.51 | 0.695 | 700 | 200 | 13 | 213 | Usual | 5.70 | Slight hop |
| 104 | 336 | 3.52 | 0.697 | 960 | 197 | 16 | 213 | Slightly low | 5.32 | Slightly weak ball |
| 105 | 336 | 3.53 | 0.699 | 1050 | 190 | 20 | 210 | Low | 5.14 | Weak ball |
| 106 | 336 | 3.76 | 0.744 | 470 | 189 | 3 | 192 | Very high | 6.46 | Unstable Hop |
| 107 | 336 | 3.77 | 0.746 | 576 | 201 | 6 | 207 | High | 6.18 | Hop |

TABLE 1-continued

| No. | Dimples Number | Dimples Diameter (mm) | K value | α value | Carrying Distance (m) | Rolling Distance (m) | Total Distance (m) | Height of Trajectory | Flight Time (sec) | Shape of Trajectory |
|---|---|---|---|---|---|---|---|---|---|---|
| 108 | 336 | 3.79 | 0.750 | 740 | 199 | 18 | 217 | Usual | 5.71 | Slight hop |
| 109 | 336 | 3.78 | 0.748 | 855 | 197 | 20 | 217 | Usual | 5.55 | Slightly weak ball |
| 110 | 336 | 3.78 | 0.748 | 1150 | 185 | 26 | 211 | Low | 4.95 | Weak ball |
| 111 | 416 | 3.42 | 0.838 | 453 | 202 | 10 | 213 | High | 6.23 | Slight hop |
| 112 | 416 | 3.45 | 0.846 | 1055 | 192 | 26 | 218 | Low | 4.90 | Weak ball |
| 113 | 504 | 3.08 | 0.915 | 401 | 196 | 14 | 210 | High | 6.38 | Slight hop |
| 114 | 504 | 3.04 | 0.903 | 1104 | 189 | 28 | 217 | Low | 4.55 | Weak ball |

EXAMPLE 2

Two-piece balls, 41.2 mm in diameter, were tested for distance. Table 2 shows the results. Sample Nos. 11 to 13 are golf balls according to the invention, while sample Nos. 115 to 121 are those prepared for comparison.

FIG. 5, curve CC represents the relationship between the total distance and the α value as determined by sample Nos. 11 to 13, 120 and 121.

Table 2 shows that sample Nos. 11 to 13 (having 416 dimples with a diameter of about 3.45 mm) are at least 6 m longer in total distance than sample Nos. 115 to 119 having 336 dimples and have a satisfactory trajectory.

Sample Nos. 120 and 121 have 416 dimples, are similar to sample Nos. 11 to 13 in K value, but are outside the range of 500 to 1000 in α value, and are therefore inferior to the golf balls of the invention in total distance.

TABLE 2

| No. | Dimples Number | Dimples Diameter (mm) | K value | α value | Carrying Distance (m) | Rolling Distance (m) | Total Distance (m) | Height of Trajectory | Flight Time (sec) | Shape of Trajectory |
|---|---|---|---|---|---|---|---|---|---|---|
| 11 | 416 | 3.47 | 0.850 | 521 | 208 | 21 | 229 | Slightly high | — | Good |
| 12 | 416 | 3.44 | 0.843 | 629 | 204 | 29 | 233 | Usual | — | Good |
| 13 | 416 | 3.46 | 0.848 | 780 | 201 | 31 | 232 | Usual | — | Good |
| 115 | 336 | 3.79 | 0.750 | 470 | 195 | 10 | 205 | Varying | — | Unstable |
| 116 | 336 | 3.81 | 0.754 | 550 | 201 | 14 | 215 | High | — | Slight hop |
| 117 | 336 | 3.77 | 0.746 | 618 | 202 | 21 | 223 | Usual | — | Slightly weak ball |
| 118 | 336 | 3.81 | 0.754 | 960 | 194 | 27 | 221 | Low | — | Weak ball |
| 119 | 336 | 3.80 | 0.752 | 1025 | 188 | 31 | 219 | Very low | — | Weak ball |
| 120 | 416 | 3.45 | 0.846 | 466 | 204 | 17 | 221 | High | — | Slight hop |
| 121 | 416 | 3.47 | 0.850 | 1080 | 190 | 33 | 223 | Low | — | Weak ball |

EXAMPLE 3

Thread-wound balata-covered balls, 42.7 mm in diameter were tested for distance. Table 3 shows the results. Sample Nos. 14 to 16 are golf balls according to the invention, while sample Nos. 122 to 128 are those prepared for comparison.

FIG. 5, curve DD represents the relationship between the total distance and the α value as determined by sample Nos. 14 to 16, 127 and 128.

Table 3 shows that sample Nos. 14 to 16 (having 416 dimples with a diameter of about 3.55 mm) are at least 5 m longer in total distance than sample Nos. 122 to 126 having 336 dimples and have a satisfactory trajectory.

Samples Nos. 127 and 128, although having 416 dimples and similar to sample Nos. 14 to 16 in K value, are outside the range of 500 to 1000 in α value and are therefore inferior to the golf balls of the invention in total distance.

TABLE 3

| No. | Dimples Number | Dimples Diameter (mm) | K value | α value | Carrying Distance (m) | Rolling Distance (m) | Total Distance (m) | Height of Trajectory | Flight Time (sec) | Shape of Trajectory |
|---|---|---|---|---|---|---|---|---|---|---|
| 14 | 416 | 3.56 | 0.812 | 625 | 202 | 11 | 213 | Slightly high | — | Good |
| 15 | 416 | 3.54 | 0.808 | 781 | 201 | 17 | 218 | Usual | — | Good |
| 16 | 416 | 3.57 | 0.815 | 981 | 194 | 20 | 214 | Slightly low | — | Good |
| 122 | 336 | 3.89 | 0.717 | 465 | 179 | 2 | 181 | Varying High | — | Unstable |
| 123 | 336 | 3.88 | 0.715 | 585 | 197 | 7 | 204 | Markedly high | — | Hop |
| 124 | 336 | 3.89 | 0.717 | 755 | 198 | 10 | 208 | High | — | Hop |
| 125 | 336 | 3.86 | 0.711 | 933 | 194 | 12 | 206 | Usual | — | Slight hop |
| 126 | 336 | 3.86 | 0.711 | 1055 | 186 | 18 | 204 | Low | — | Weak ball |
| 127 | 416 | 3.57 | 0.815 | 487 | 197 | 7 | 204 | High | — | Hop |
| 128 | 416 | 3.57 | 0.815 | 1120 | 182 | 25 | 207 | Low | — | Weak ball |

EXAMPLE 4

Two kinds of thread-wound balata-covered golf balls having 41.2 mm in diameter and 504 or 600 dimples were tested for the decrease in distance that would result from repeated shooting. The ball was checked before and after being hammered 20 times. Table 4 shows the specifications of the balls tested, and Table 5 the test results.

A grooved metal plate substantially equivalent to the club face was caused to strike the ball at a speed of 45 m/sec by an air gun for hammering to check the ball for durability. The procedure including hammering 20 times corresponds to about 1 to 2 usual golf rounds.

TABLE 4

| | Ball of invention | Ball for comparison |
|---|---|---|
| Diameter of ball (mm) | 41.2 | 41.2 |
| Number of dimples | 504 | 600 |
| Diameter of dimples (mm) | 3.03 | 2.79 |
| K value | 0.900 | 0.986 |
| $\alpha$ Value | 635 | 601 |

TABLE 5

| | Ball of invention | | Ball for comparison | |
|---|---|---|---|---|
| | Before hammering | After hammering | Before hammering | After hammering |
| Carrying distance (m) | 206 | 208 | 208 | 204 |
| Rolling distance (m) | 19 | 15 | 21 | 12 |
| Total distance (m) | 225 | 223 | 229 | 216 |
| Height of trajectory | Usual | Slightly high | Usual | High |
| Shape of trajectory | Good | Good | Good | Hop |

Table 5 reveals that the hammering (20 times) produced a difference of only 2 m in total distance in the case of the balls of the invention but that the corresponding difference in the comparison balls was as large as 13 m, hence undesirable for playing golf.

The poor result achieved by the comparison balls (having 600 dimples) appears attributable to the following reason. In order to obtain an $\alpha$ value within the optimum range, the dimples must have a reduced depth, so that even if exhibiting high performance initially, the ball undergoes a marked change in performance as the number of shots increases due to the resulting wear of the dimple edge and reduction in the depth of the dimple.

Golf balls having such shallow dimples also encounter many problems in the manufacturing process because even slight variations in the thickness of the coating usually formed over the golf ball greatly influence the performance.

EXAMPLE 6

Figure 6:
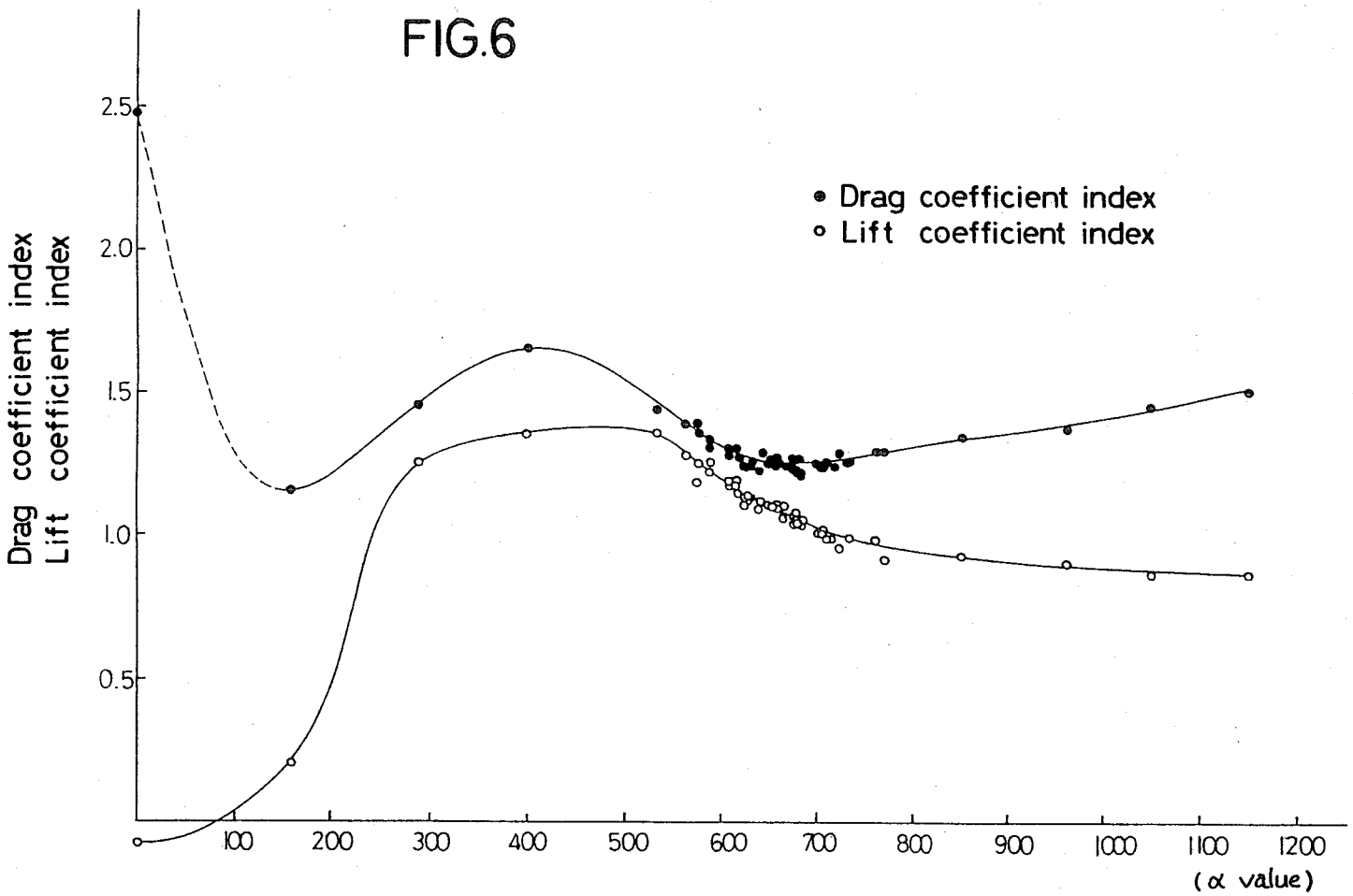
FIG. 6 is a graph showing the relationship between the $\alpha$ value and the aerodynamic characteristic values as determined by a wind tunnel experiment.

A wind tunnel experiment was conducted to substantiate the importance of limiting the $\alpha$ value to the range of 500 to 1000, with the results shown in FIG. 6.

The wind tunnel experiment was performed by known means (Proceedings of the 19th Japan National Congress for Applied Mechanics, 1969, pp. 167–170).

Four golf balls were tested three times under 24 conditions (6 conditions for Reynolds number and 4 spin conditions) to obtain 288 points, from which a curve was obtained statistically. Each point in FIG. 6 was determined by reading a value for a Reynolds number of $1.5\times10^5$ and spin of 4000 r.p.m. from the curve.

The drag coefficient index and lift coefficient index are expressed in terms of lift coefficient ratio of a sample having an $\alpha$ value of 700.

While wind tunnel experiments afford the lift coefficient and the drag coefficient, it is generally thought that golf balls have better aerodynamic characteristics if the lift coefficient is greater and the drag coefficient is smaller. Since the characteristics are more dependent on the drag coefficient, $\alpha$ of about 600 to about 800 is most desirable at which the drag coefficient is lowest in FIG. 6. Furthermore $\alpha$ of 500 to 600 is also effective in that the lift-drag ratio is great. It is also generally known that even if the lift coefficient is somewhat lower, golf balls have a good trajectory provided that the drag coefficient is small. Accordingly, when considering the condition that the lift coefficient index should be at least 0.6 and the drag coefficient index should be up to 1.5, the $\alpha$ value is preferably in the range of 500 to 1000.

If the $\alpha$ value is below 500, the drag coefficient is great although the lift coefficient is high, so that a reduced distance and variations in the trajectory will result.

Although the optimum range of $\alpha$ values slightly differs according to the diameter and structure of golf ball, it is desirable that the $\alpha$ value be in the range of 500 to 1000.

What is claimed is:

1. A golf ball having a spherical surface containing therein eight triangular areas divided by phantom lines and extended over the spherical surface, each of the triangular areas comprising three sides of equal spherical length, the golf ball being provided on the spherical surface to form 52 dimples in each of the triangular areas without adjacent dimples overlapping each other and to form totally 416 dimples, said 52 dimples being so arranged that a first spherically shaped triangle formed inside and along the triangular area defined by the phantom lines comprises three sides of equal spherical length and includes 9 dimples formed on each of the side lines to provide totally 24 dimples, a second spherically shaped triangle formed inside and along the first triangle comprises three sides of equal spherical length and includes 7 dimples formed on each of the side lines to provide totally 18 dimples, and a third spherically shaped triangle formed inside and along the second triangle includes 4 dimples formed on each of the side lines to provide totally 9 dimples and further includes 1 dimple inside thereof, said golf ball having a diameter of the dimples being 3.2 to 3.6 mm and of a dimple depth such that the total volume of the dimples is in the range of 222 to 476 $mm^3$

2. The golf ball as defined in claim 1 wherein the ball having 41.2 mm diameter is in the range of 238 to 476 $mm^3$ in the total volume of the dimples.

3. The golf ball as defined in claim 1 wherein the ball having 42.7 mm diameter is in the range of 238 to 476 $mm^3$ in the total volume of the dimples.

* * * * *

UNITED STATES PATENT AND TRADEMARK OFFICE

CERTIFICATE OF CORRECTION

PATENT NO. : 4,720,111

DATED : January 19, 1988

INVENTOR(S) : Kaname YAMADA

It is certified that error appears in the above-identified patent and that said Letters Patent is hereby corrected as shown below:

On the drawing sheet 2 of 3, delete Figure 4 and insert new Figure 4, as shown below.

FIG. 4

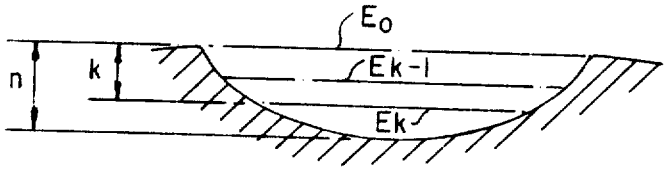

Signed and Sealed this

Seventh Day of March, 1989

*Attest:*

DONALD J. QUIGG

*Attesting Officer*

*Commissioner of Patents and Trademarks*